United States Patent [19]

Haller

[11] 4,059,937

[45] Nov. 29, 1977

[54] STEEL GIRDER

[75] Inventor: Fritz Haller, Solothurn, Switzerland

[73] Assignee: U. Scharer Sohne AG, (USM), Munsinger, Switzerland

[21] Appl. No.: 689,798

[22] Filed: May 25, 1976

[30] Foreign Application Priority Data

May 30, 1975 Switzerland ..... 7031/75

[51] Int. Cl.[2] ..... E04C 3/04

[52] U.S. Cl. ..... 52/693

[58] Field of Search ..... 52/633, 84, 650, 693, 52/648, 696, 694, 690, 639, 634, 629, 632, 731

[56] References Cited

U.S. PATENT DOCUMENTS

| | | | |
|---|---|---|---|
| 2,027,711 | 1/1936 | Sutton | 52/731 |
| 3,735,544 | 5/1973 | Longlnotti | 52/235 |

FOREIGN PATENT DOCUMENTS

| | | | |
|---|---|---|---|
| 636,273 | 2/1962 | Canada | 52/650 |
| 2,231,275 | 12/1974 | France | 52/731 |

*Primary Examiner*—John E. Murtagh

*Attorney, Agent, or Firm*—Zarley, McKee, Thomte, Voorhees & Sease

[57] ABSTRACT

A steel girder of the type having a cross-section in the shape of a rectangle comprises four parallel L-beams situated at respective corners of the rectangle, strut elements disposed opposite one another in pairs and parallel to the longer sides of the rectangle, and connecting elements each having a flat, substantially H-shaped web portion and two flanges projecting at right angles from the outer edges of the web portion, the web portions sloping at a uniform angle to the L-beams toward the shorter sides of the rectangle.

2 Claims, 1 Drawing Figure

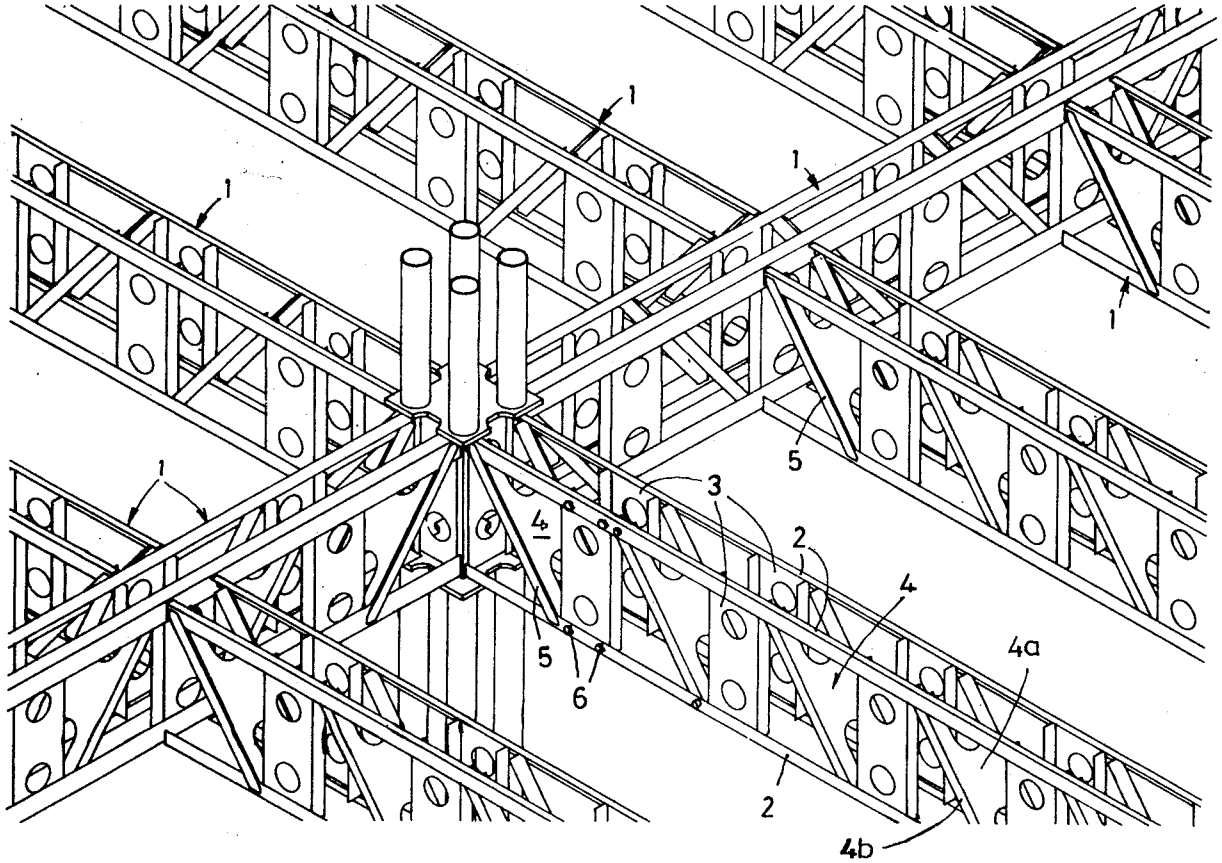
1
1
1
1
1
5
2
3
4
4a
4b
2
6
5
4

STEEL GIRDER

This invention relates to steel girders, particularly to a steel girder for building construction, of the type having a cross-section in the shape of a rectangle, wherein four parallelL-beams are situated at respective corners of the rectange, a first leg of each L-beam being parallel to the longer sides of the rectangle and a second leg of each L-beam being parallel to the shorter sides of the rectangle, wherein a plurality of strut elements are disposed opposite one another in pairs and parallel to the longer sides of the rectangle for connecting respective pairs of L-beams, and wherein bracing means perpendicular to the strut elements connect the L-beams diagonally.

A known steel girder of this tape is shown, for example, in *Acier-Stahl-Steel,* No. 5/1968, p. 219; it comprises bracing means consisting of diagonal struts disposed at the longer sides of the cross-sectional rectangle at an angle to the L-beams, and of cross-struts disposed at the shorter sides of the rectangle at right angles to the L-beams. Both the diagonal struts and the cross-struts take the form of L-sections.

It is an object of this invention to provide an improved girder of the aforementioned type which is structurally simplified as compared with the prior art girders and which thus requires less time and labor for its assembly.

A further object of this invention is to provide a girder which is superior from the standpoint of structural statics in that the bracing means reinforce the girder to prevent its rectangular cross-section from being deformed into a parallelogram under eccentric loading.

Still another object of this invention is to provide a girder which dispenses with the cross-struts of the prior art design and is thus open along its entire length at the shorter sides of its cross-section, thereby enabling unobstructed insertion of pipes, wiring, etc., even when the girder has already been incorporated along with other such girders and with columns in the steel framework of a building.

According to the present invention, the foregoing and other objects are attained by providing bracing means comprising a plurality of connecting elements, each having a flat, substantially H-shaped web portion with parallel outer edges and two flanges projecting at right angles from these outer edges, the web portions sloping at a uniform angle to the L-beams toward the shorter sides of the cross-sectional rectangle, and the flanges resting against and being secured to respective first legs of the L-beams.

A preferred embodiment of the invention will now be described in detail with reference to the accompanying drawing, the sole FIGURE of which is a perspective view of part of an upper story of the framework of a building utilizing a number of steel girders according to the invention.

Each steel girder illustrated in the drawing is designated as a whole by reference numeral 1 and comprises as its essential parts a. four L-beams 2 disposed parallel to one another at the corners of an imaginary upright rectangle, b. a plurality of strut elements 3 distributed along the length of girder 1 running parallel to the longer sides of the imaginary rectangle, disposed opposite one another in pairs, and connecting L-beams 2 in pairs, and c. a plurality of connecting elements 4 disposed within the longitudinal sections of girder 1 let free by strut elements 3 and within the longitudinal sections of girder 1 at each end thereof.

Connecting elements 4 form the novel bracing means in the steel girder proposed according to this invention. Each connecting element 4 includes a flat, substantially H-shaped web portion **4*a* and two flanges 4*b* projecting at right angles from the parallel outer edges of web portion 4*a*. Web portions 4*a* of all connecting elements 4 slope toward the shorter sides of the rectangle formed by the cross-section of girder 1, at a uniform angle of about 40° to 60° with respect to the L-beams 2 connected to each other by connecting elements 4. Flanges 4*b* lie against the inside of those legs of L-beams 2 which lie in a plane parallel to flanges 4*b*, and are secured to those legs. Adjacent to the flanges 4*b* of the connecting elements 4 situated at the end of each girder 1, there are also flat iron bars 5 resting against and secured to the aforementioned legs of L-beams 2. As can be seen from the drawing, the pairs of strut elements 3 are disposed in those intervals of length of each girder 1 which are let free by the connecting elements 4**.

Strut elements 3, connecting elements 4, and flat iron bars 5 are conventionally secured to L-beams 2 by means of bolts or rivets 6, most of which have been omitted from the drawing.

What is claimed is:

1. A steel girder rectangular in cross-section and having a top portion, bottom portion and opposite side portions, four elongated parallel beams located at the respective corners of said rectangular cross-section, pairs of spaced-apart strut elements disposed on opposite sides of said girder for connecting pairs of said beams on the top and bottom portions of said girder, diagonally disposed H-shaped bracing elements secured within said girder and extending from the lower ends of one pair of strut elements to the upper ends of an adjacent pair of strut elements, said H-shaped bracing elements having oppositely disposed open U-shaped recesses in their upper and lower ends to provide a continuous unobstructed open space in the top and bottom portions of said girder to provide ease of mounting auxiliary elongated building components within said girder.

2. The girder of claim 1 wherein access openings are located in said strut elements to provide lateral communication with said unobstructed open spaces from the sides of said girder.

* * * * *